United States Patent [19]

Weeks

[11] 4,281,305

[45] Jul. 28, 1981

[54] ELECTROMAGNETIC SWITCHING APPARATUS

[75] Inventor: Robert W. Weeks, Lyndhurst, Ohio

[73] Assignee: Clark Control, Inc., Cleveland, Ohio

[21] Appl. No.: 50,000

[22] Filed: Jun. 18, 1979

[51] Int. Cl.[3] ..... H01H 50/16

[52] U.S. Cl. ..... 335/132; 335/202

[58] Field of Search ..... 335/132, 198, 202

[56] References Cited

U.S. PATENT DOCUMENTS

| | | | |
|---|---|---|---|
| 2,924,685 | 2/1960 | Burch | 335/132 |
| 3,368,171 | 2/1968 | Conner et al. | 335/132 |
| 3,451,018 | 6/1969 | DiMarco | 335/132 |
| 3,458,838 | 7/1969 | Isler | 335/132 |
| 3,832,657 | 8/1974 | Hardman et al. | 335/198 |
| 3,873,952 | 3/1975 | Kondo et al. | 335/132 |
| 4,087,770 | 5/1978 | Kuhn et al. | 335/132 |
| 4,184,134 | 1/1980 | Kane et al. | 335/132 |

*Primary Examiner*—Harold Broome
*Attorney, Agent, or Firm*—David M. Keay

[57] ABSTRACT

Electromagnetically operated contactor or relay in which the stationary magnetic core and operating coil are mounted in a base section and the movable armature and the switching elements are mounted in a main frame section. With the two sections assembled together the pole face structures of the stationary core abut reference surfaces in the main frame section. When the operating coil is energized, the armature moves into contact with the pole faces of the stationary core. Thus, since the reference surfaces in the main frame section determine the position of the stationary core pole faces and hence the position of the armature when the core is energized, the positions of all movable elements are determined solely by dimensions of the main frame section independently of the base section.

8 Claims, 6 Drawing Figures

ELECTROMAGNETIC SWITCHING APPARATUS

CROSS-REFERENCE TO RELATED APPLICATION

This application describes and claims subject matter disclosed in application Ser. No. 933,320 filed Aug. 14, 1978, now U.S. Pat. No. 4,184,134, by Hugh Kane and Bruce A. Oellerich entitled "Electrical Switching Apparatus" and assigned to the assignee of the present application.

BACKGROUND OF THE INVENTION

This invention relates to electrical switching apparatus. More particularly, it is concerned with electromagnetically operated switching apparatus employing a plurality of contact modules.

Electrical switching apparatus such as electromagnetic contactors or relays are widely used in industrial control systems. In order to provide versitility contactors of this general type frequently employ switch or contact modules which selectively may be changed to provide either normally open or normally closed circuit conditions. The contact modules are actuated to switch between circuit conditions by appropriately energizing and deenergizing the coil of an electromagnet. When the coil is energized a movable armature moves into contact with a stationary magnet, and when the coil is deenergized the armature is returned to its original position by compression springs. Linkage members couple the movable armature to elements within the contact modules so that movement of the armature between the two positions switches the contact elements of each module to provide the desired open and closed circuits therethrough.

In order to provide for proper operation of the contact modules the distance between the energized and deenergized positions of the movable armature and the positioning of the contact modules with respect to the two positions of the movable armature should be accurately controlled. In switching apparatus heretofore available, however, the aforementioned relationships were determined by the net results of several dimensions of several assembled parts. Because of the accumulation of dimensional errors tight dimensional tolerances were necessary in order to control the relationships within the desired degree of accuracy.

SUMMARY OF THE INVENTION

In electromagnetic switching apparatus in accordance with the present invention the positions of the movable armature are determined by the dimensions of a single section of the housing and are, therefore, more readily controlled. The apparatus comprises a first housing section having an operating coil and a stationary magnetic core positioned therein with the coil and core being magnetically coupled. The magnetic core has a pair of pole face structures. The apparatus also includes a second housing section which has a pair of reference surfaces. The two housing sections are attached to each other with the pole face structures of the stationary magnetic core abutting the reference surfaces of the second housing section. A movable armature is mounted within the second housing section so as to permit reciprocating movement between a first position in which the armature abuts the pole face structures of the magnetic core and a second position in which the armature is spaced from the magnetic core. Switch means are mounted within the second housing section. Switch actuator means which move with the movable armature are coupled to the switch means for actuating the switch means upon movement of the armature between the two positions. All movable elements including the movable armature of the magnetic circuit are mounted within the second housing section and their positions are determined by dimensions of the second housing section.

Figure 1:
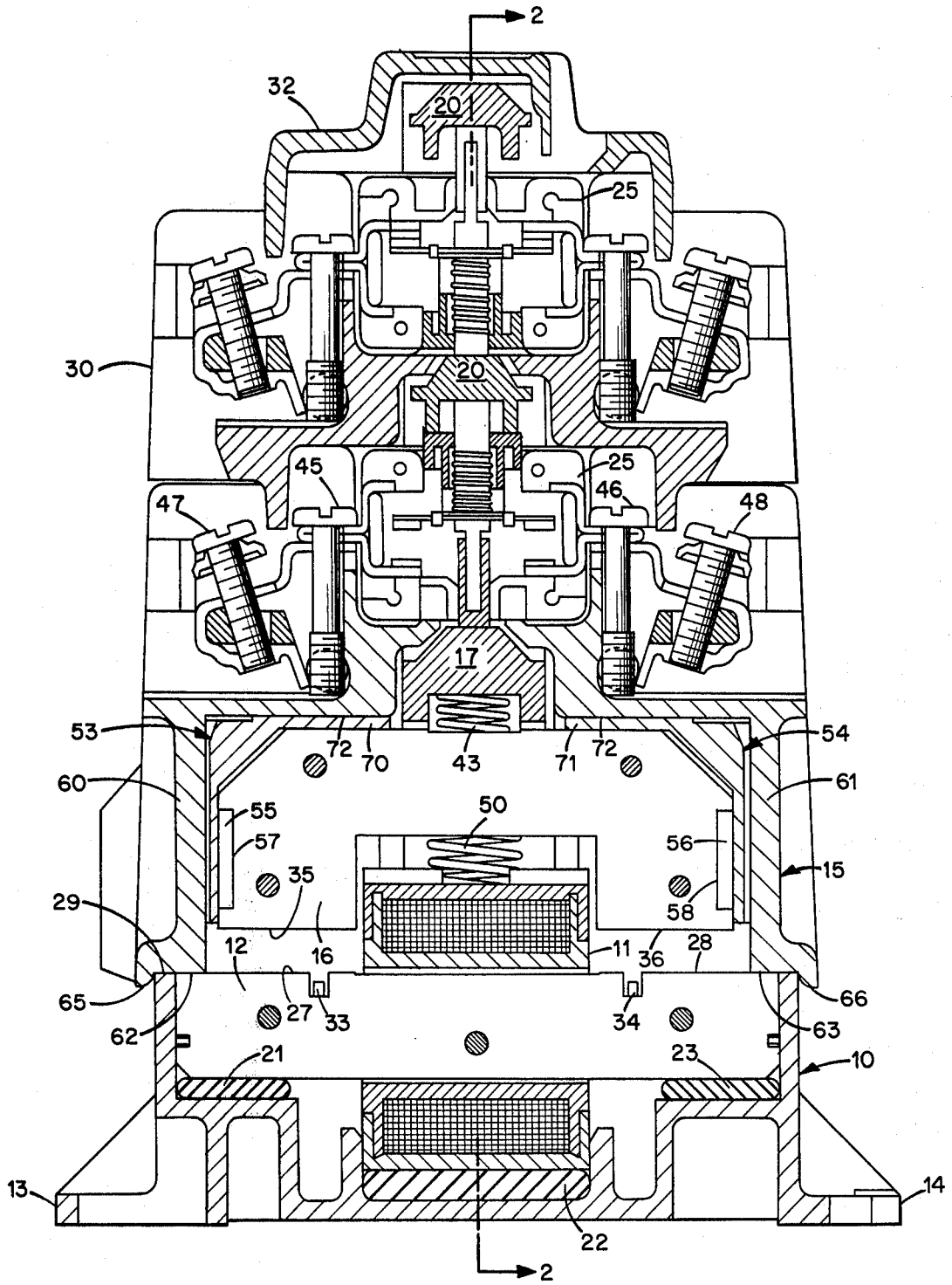
FIG. 1 is an elevational view partially in cross-section of an electromagnetically operated contactor in accordance with the present invention.

For a better understanding of the present invention, together with other and further objects, advantages, and capabilities thereof, reference is made to the following discussion and appended claims in connection with the above-described drawings.

DETAILED DESCRIPTION OF THE INVENTION

An electromagnetically operated contactor in accordance with the present invention is illustrated in the figures of the drawing. The apparatus includes a first housing section or base 10 which may be of die-cast zinc for containing the stationary elements of the magnetic circuit. These elements include an electromagnetic coil 11 and a stationary core or yoke 12 which is supported within the electromagnetic coil and is magnetically coupled to it. The base 10 has lugs 13 and 14 affixed thereto for mounting the contactor.

Figure 2:
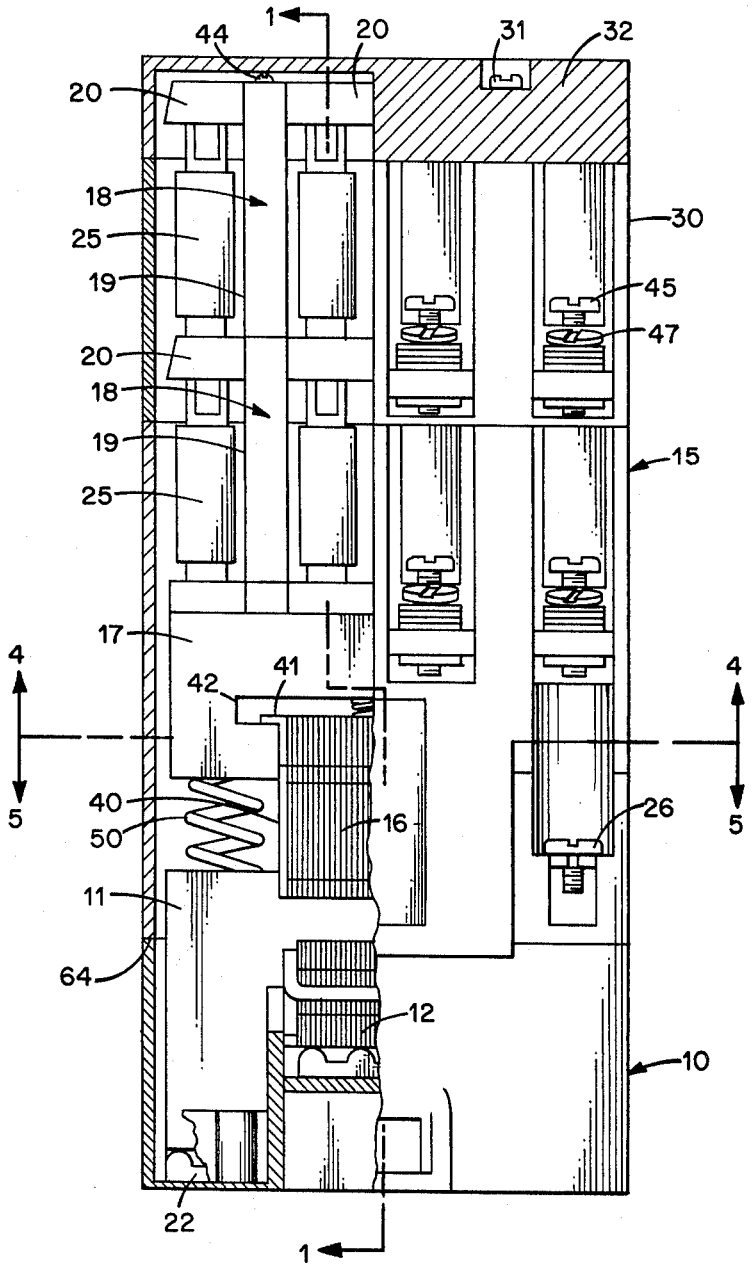
FIG. 2 is an elevational view of the contactor of FIG. 1 partially in cross-section taken generally along the line 2—2 of FIG. 1.
Figure 3:
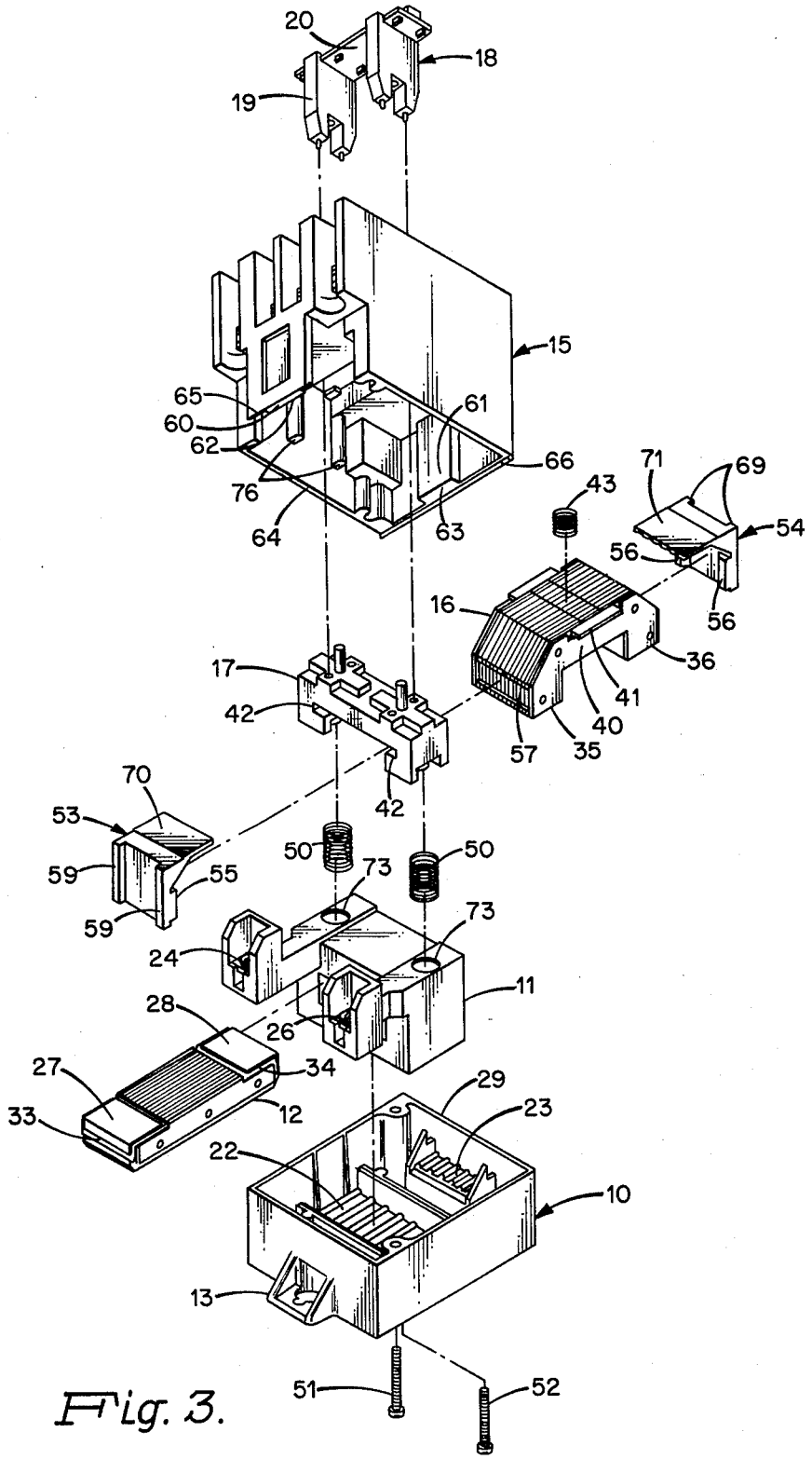
FIG. 3 is an exploded view in perspective of portions of the contactor.

The apparatus includes a second housing section or main frame 15 of insulating material such as molded thermosetting plastic. The base 10 is attached to the main frame 15 by bolts 51 and 52 which pass through the base and engage threaded inserts in the main frame. The movable armature 16 of the magnetic circuit is mounted within the main frame 15 so as to permit reciprocating movement in the vertical directions as shown in FIGS. 1 and 2 as will be explained in detail hereinbelow. The main frame 15 includes compartments capable of supporting four identical switch or contact modules 25. The contact modules are convertible to provide either normally open or normally closed contact conditions depending upon their mounting position. The movable armature 16 is coupled to the contact modules 25 by actuating linkage mechanism including a carrier 17 which is mounted on the armature and a mechanical tie member 18 attached to the carrier. Reciprocating movement of the armature 16 in response to energizing and deenergizing of the coil 11 is thus transferred to movable elements in the contact modules 25 opening and closing their contacts. Details of the contact modules 25, the manner in which they are removably mounted in the main frame, and the manner in which electrical connections are made thereto are described in detail in the copending application of Kane and Oellerich referenced hereinabove.

The apparatus as shown in the drawings also includes a third housing section or upper module housing 30 having compartments for four additional contact modules 25 and supporting a second mechanical tie member 18. A cover 32 is placed on the upper module housing 30 and removable bolts 31 extend through the cover and upper module housing and into threaded inserts in the main frame 15 to assemble these sections together.

The operating coil 11 and the stationary core 12 of the magnetic circuit are mounted within the base 10. The operating coil 11 includes a coil winding within protective insulating supporting structure. Electrical connection is made to the coil by terminals 24 and 26 mounted in arms extending from the coil supporting structure. The coil has an opening to receive the stationary core 12. The core is an assembly of laminations having a pair of pole faces 27 and 28 which lie in a common plane. The pole face structures may or may not include pole shading elements associated with the pole faces. In the apparatus illustrated pole shading elements 33 and 34 are embedded in the pole faces.

The operating coil 11 and the core 12 are mounted in the base 10 on resilient pads of elastomeric material 21, 22, and 23. The pads are adapted to yield somewhat under pressure and thus provide a shock mounting for the stationary elements of the magnetic circuit. In addition, when the base 10 is disassembled from the main frame 15, the resilient pads cause the plane of the pole face structures 27 and 28 to be slightly above the edge surfaces 29 of the base 10 for purposes to be explained hereinbelow.

The movable elements of the magnetic circuit and a set of four contact modules 25 are mounted within the main frame 15. The movable magnetic armature 16 is located within a lower chamber in the main frame and the four contact modules are removably supported in compartments above the armature chamber. The mechanical tie member 18 has two supporting legs 19 which extend through openings in the main frame and into contact with the carrier 17. The mechanical tie member 18 also has lateral arms 20 extending therefrom. The carrier 17 and the lateral arms 20 of the mechanical tie member engage the movable elements of the contact modules 25. Portions of two opposite sidewalls of the main frame 15 protrude inwardly into the armature chamber to form two bosses 60 and 61. The lower surfaces of the bosses 60 and 61 provide two flat reference surfaces 62 and 63, respectively, which lie in a common plane. The lower edges 64 of the main frame 15 lie generally in the same plane as the reference surfaces 62 and 63. Flanges 65 and 66 extend below the lower edge 64 in the region of the reference surfaces 62 and 63.

When the base 10 containing the stationary elements of the magnetic circuit as described hereinabove is assembled with the main frame 15, the pole faces 27 and 28 of the magnetic core 12 contact the reference surfaces 62 and 63, respectively, as best seen in FIG. 1. As fastening bolts 51 and 52 are tightened, the resilient pads 21 and 23 and also 22 are slightly compressed holding the pole faces firmly against the reference surfaces. When the bolts 51 and 52 are completely tightened, the upper edges 29 of the base 10 abut the lower edges 64 of the main frame 15. The flanges 65 and 66 assist in properly positioning the two sections of the housing.

Figure 4:
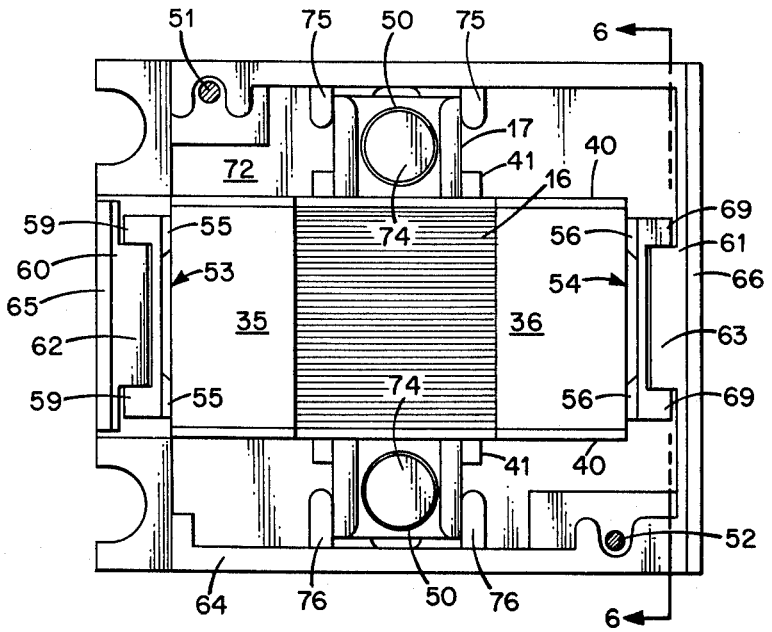
FIG. 4 is a view of the contactor partially in cross-section taken generally along the line 4—4 of FIG. 2.
Figure 5:
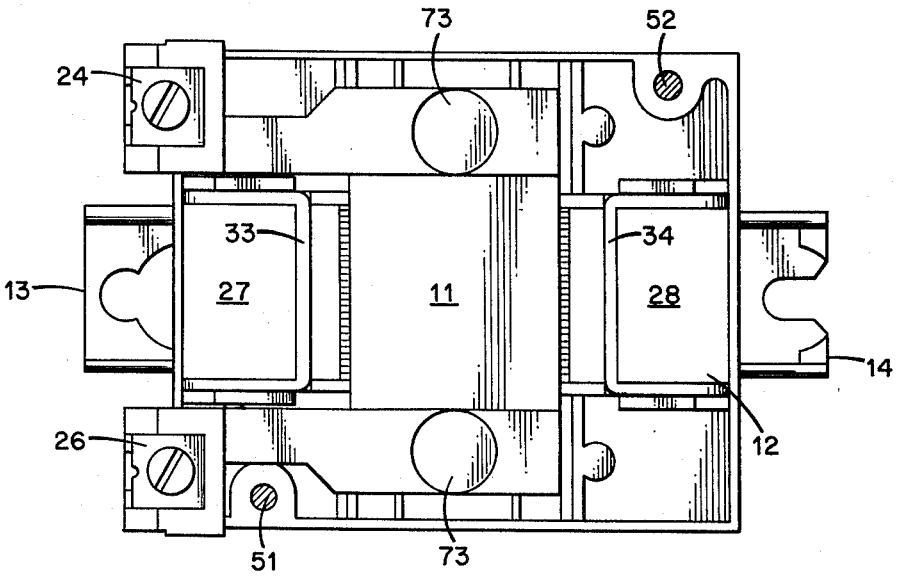
FIG. 5 is a view of the contactor partially in cross-section taken generally along the line 5—5 of FIG. 2.
Figure 6:
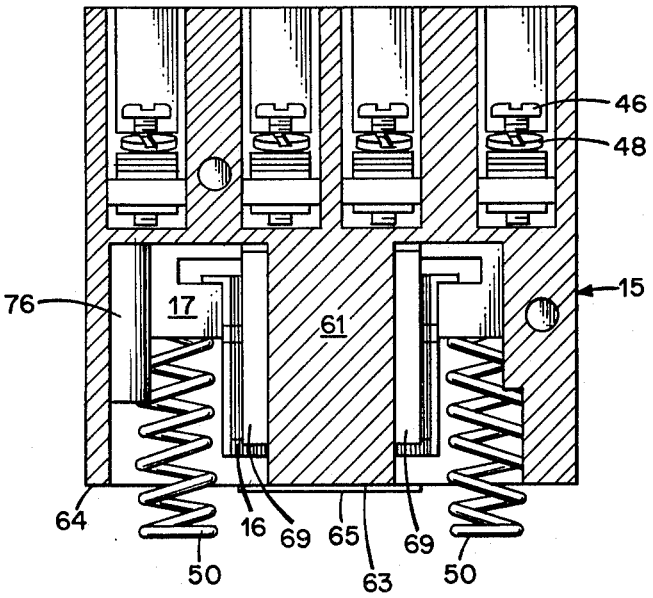
FIG. 6 is a view of a portion of the contactor partially in cross-section taken generally along the line 6—6 of FIG. 4.

The movable armature 16 is an assembly of a plurality of laminations and has two side plates 40 with outwardly extending flanges 41. In the apparatus shown the armature is U-shaped and has two pole faces 35 and 36 which lie in the same plane generally opposite the pole faces 27 and 28, respectively, of the magnetic core 12. The armature 16 is located within the chamber of the main frame 15 and suitably mounted so as to permit reciprocating movement in the direction of the principal axis of the apparatus. Held fixed with respect to the armature are two similar low friction slide members 53 and 54 which move with the armature and make sliding contact with the main frame 15. The slide members 53 and 54 each have two protrusions 55 and 56 which engage notches 57 and 58, respectively, in the ends of the armature laminations. The armature side plates 40 extend beyond the notches preventing lateral movement of the slide members with respect to the armature. The slide members 53 and 54 also have two outwardly extending protrusions 59 and 69 which lie on opposite sides of the bosses 60 and 61, respectively, of the main frame 15 (see FIG. 4). Thus, the bosses 60 and 61 act as guideways providing lateral support for the slide members 53 and 54 and armature 16 as they move along the axis of actuation. The slide members 53 and 54 each have a laterally extending portion 70 and 71, respectively, which overlies the upper surface of the armature. The portions 70 and 71 are ribbed and serve as shock absorbing elements between the armature and the surface 72 of the main frame 15 as the armature is urged into the deenergized position. The slide members are of a low friction material, specifically Nylontron GS, thus providing a satisfactory bearing surface against the surfaces of the main frame.

The carrier 17 is mounted on the armature 16 in a resilient arrangement by the engagement of the flanges 41 of the armature side plates with slots 42 in the carrier together with a compression spring 43 seated in a recess in the carrier 17 and bearing against the armature 16. The carrier and armature are urged away from the stationary core 12 by two compression springs 50 which are positioned in recesses 73 in the supporting structure of the operating coil 11 and engage bosses 74 on the carrier 17. The ends of the carrier travel in channels formed by pairs of bosses 75 and 76 in the main frame 15 as the armature moves along the axis of actuation (see FIG. 4).

The carrier 17 and the lateral arms 20 of a mechanical tie member 18 engage the movable elements of the contact modules 25 located in the main frame 15. A second mechanical tie member 18 is mounted on the first mechanical tie member and the two mechanical tie members are attached to the carrier 17 by through bolts 44 threaded into inserts in the carrier. The lateral arms 20 of the two mechanical tie members 18 engage the movable elements of the second set of contact modules 25 located in the upper module housing 30. Movement of the armature in response to energizing and deenergizing of the operating coil is thus transmitted to the contact modules to change the switching states of their contacts. Each contact module 25 is held against mounting surface in its respective compartment by a pair of screw fasteners 45 and 46. Electrical connections are made to each contact module by a pair of terminals 47 and 48. Details of the manner of mounting the contact modules and making electrical connection thereto are described in the copending application of Kane and Oellerich referred to hereinabove.

Under operating conditions of the apparatus when the operating coil 11 is deenergized, return springs 50 hold the movable armature 16 in its uppermost position with the portions 70 and 71 of the slide members 53 and 54, respectively, against the stop surface 72 interior of the chamber in the main frame 15 (see FIG. 1). When the operating coil is energized, the movable armature 16 is drawn downward with its pole faces 35 and 36 abutting the pole faces 27 and 28 of the stationary magnetic core 12. That is, when the apparatus is in the energized state the pole face structures of the movable armature are at the plane of the reference surfaces 62 and 63 of the main frame 15.

In the apparatus as described the movable armature, and therefore the actuating linkage coupled thereto for operating the contact modules, reciprocates between two positions which are determined by dimensions solely within the main frame section 15 of the housing. The reference surfaces 62 and 63 at the lower edge of the main frame 15 establish the energized position of the armature 16 by virtue of precisely locating the pole face structures 27 and 28 of the stationary magnetic core 12 against which the armature abuts. The deenergized position of the armature is determined by the stop surface 72 of the armature chamber of the main frame against which the slide members 53 and 54 carried by the armature 16 abut. Since the main frame 15 is a unitary molded structure, the distance between the reference surfaces 62 and 63 and the stop surface 72 is readily controlled to the desired tolerance. In addition, the position of the set of contact modules 25 located in the main frame is determined by the distances from the reference surfaces 62 and 63 and from the stop surface 72 to the supporting surfaces on which the contact modules are mounted. All of these dimensions and their relationships remain fixed after manufacture of the individual parts primarily the main frame and are not affected by variables introduced by the assembly of large numbers of parts each with its individual errors as in devices previously available.

While there has been shown and described what is considered a preferred embodiment of the present invention, it will be obvious to those skilled in the art that various changes and modifications may be made therein without departing from the invention as defined by the appended claims.

What is claimed is:

1. An electromagnetic switching apparatus comprising a first housing section;

an operating coil positioned in said first housing section;

a stationary magnetic core positioned in said first housing section and magnetically coupled to the operating coil;

said magnetic core having a pair of pole face structures;

a second housing section;

said second housing section having a pair of reference surfaces;

means for attaching said first and second housing sections together with the pole face structures of said magnetic core abutting the reference surfaces of the second housing section;

a movable armature mounted within said second housing section for reciprocating movement between a first position in which the armature abuts the pole face structures of the magnetic core and a second position in which the armature is spaced from the magnetic core;

switch means mounted in said second housing section; and switch actuator means movable with the movable armature and coupled to said switch means for actuating said switch means upon movement of the armature between said positions.

2. An electromagnetic switching apparatus in accordance with claim 1 wherein said second housing section includes a stop surface at a predetermined distance along the direction of movement of the armature from said reference surfaces, said predetermined distance establishing the distance of movement of the movable armature between the first and second positions;

and including bias spring means for urging said movable armature toward said stop surface when the operating coil is deenergized;

said movable armature being magnetically attracted into contact with the pole face structures of the stationary magnetic core when the operating coil is energized.

3. An electromagnetic switching apparatus in accordance with claim 2 wherein said switch means includes a plurality of contact modules each having an open circuit state and a closed circuit state;

said switch actuator means includes linkage means connected to said movable armature and engaging said contact modules for switching the states of the contact modules upon movement of the movable armature from one position to the other;

said second housing section includes mounting surfaces for supporting said contact modules, said mounting surfaces being at a predetermined distance along the direction of movement of the armature from said reference surfaces.

4. An electromagnetic switching apparatus in accordance with claim 3 wherein each of said contact modules includes first and second contact terminals on the exterior thereof and is removably mounted in said second housing section in contact with said mounting surfaces and in engagement with the linkage means in either of two positions respectively providing normally open circuit and normally closed circuit states between the contact terminals.

5. An electromagnetic switching apparatus in accordance with claim 4 wherein said second housing section includes guideways extending along the direction of movement of the movable armature;

and including slide members of low friction material mounted on said movable armature and engaging said guideways for permitting slidable reciprocating movement of the armature within the second housing section along the guideways.

6. An electromagnetic switching apparatus in accordance with claim 5 wherein p1 said slide members include shock absorbing portions intervening between the movable armature and said stop surface.

7. An electromagnetic switching apparatus in accordance with claim 2 or 6 wherein said second housing section is a unitary structure.

8. An electromagnetic switching apparatus in accordance with claim 7 including resilient padding mounted within said first housing section for supporting said stationary magnetic core whereby said pole face structures of the stationary magnetic core are firmly and resiliently urged against said reference surfaces of the second housing section when said first and second housing sections are attached together.

* * * * *